US011821427B2

(12) United States Patent
Holbrook et al.

(10) Patent No.: US 11,821,427 B2
(45) Date of Patent: Nov. 21, 2023

(54) MULTIPLE STAGE VACUUM PUMP

(71) Applicant: Edwards Limited, Burgess Hill (GB)

(72) Inventors: Alan Ernest Kinnaird Holbrook, Burgess Hill (GB); David Bedwell, Burgess Hill (GB)

(73) Assignee: Edwards Limited, West Sussex (GB)

( * ) Notice: Subject to any disclaimer, the term of this patent is extended or adjusted under 35 U.S.C. 154(b) by 0 days.

(21) Appl. No.: 17/760,408

(22) PCT Filed: Feb. 10, 2021

(86) PCT No.: PCT/GB2021/050300
§ 371 (c)(1),
(2) Date: Aug. 9, 2022

(87) PCT Pub. No.: WO2021/161009
PCT Pub. Date: Aug. 19, 2021

(65) Prior Publication Data

US 2023/0076739 A1 Mar. 9, 2023

(30) Foreign Application Priority Data

Feb. 12, 2020 (GB) ..... 2001932

(51) Int. Cl.
*F04C 23/00* (2006.01)
*F01C 21/10* (2006.01)
(Continued)

(52) U.S. Cl.
CPC ..... *F04C 23/001* (2013.01); *F01C 21/10* (2013.01); *F04C 18/126* (2013.01); *F04C 25/02* (2013.01);
(Continued)

(58) Field of Classification Search
CPC ..... F04C 23/001; F04C 18/126; F04C 25/02; F04C 29/0014; F04C 2220/50; F04C 2240/10; F04C 2250/30; F01C 21/10
See application file for complete search history.

(56) References Cited

U.S. PATENT DOCUMENTS 3,791,780 A * 2/1974 Fritch ..... F04C 28/02 418/67
6,776,586 B2 * 8/2004 Naito ..... F04C 18/126 417/244
(Continued)

FOREIGN PATENT DOCUMENTS

EP 2071191 A2 6/2009
WO 2009044197 A2 4/2009

OTHER PUBLICATIONS

British Examination Report dated Jul. 7, 2020 and Search Report dated Jul. 6, 2020 for corresponding British Application No. GB2001932.9, 4 pages.
(Continued)

*Primary Examiner* — Mary Davis
(74) *Attorney, Agent, or Firm* — Theodore M. Magee; Westman, Champlin & Koehler, P.A.

(57) ABSTRACT

A multi-stage vacuum pump comprising a stator defining multiple pumping chambers is discussed. The stator comprises a plurality of transfer channels for providing a fluid passage from an outlet port of one of the plurality of pumping chambers to an inlet port of a subsequent pumping chamber. Some of the transfer channels comprise two side channel sections on opposing sides of the stator. One of the transfer channels comprises a single side channel section on one side of the stator. The vacuum pump further comprises a gas ballast inlet channel arranged on an other side of the stator to the one side of the stator.

11 Claims, 3 Drawing Sheets

(51) Int. Cl.

| | |
|---|---|
| ***F04C 18/12*** | (2006.01) |
| ***F04C 25/02*** | (2006.01) |
| ***F04C 29/00*** | (2006.01) |

(52) U.S. Cl.
CPC ..... *F04C 29/0014* (2013.01); *F04C 2220/50* (2013.01); *F04C 2240/10* (2013.01); *F04C 2250/30* (2013.01); *F04C 2280/04* (2013.01)

(56) References Cited

U.S. PATENT DOCUMENTS

| | | | | |
|---|---|---|---|---|
| 8,500,422 | B2 * | 8/2013 | Dowdeswell | F04C 18/126 418/9 |
| 9,869,317 | B2 * | 1/2018 | Schofield | F04C 25/02 |
| 2005/0089424 | A1 * | 4/2005 | Liu | F04C 18/126 417/244 |
| 2010/0119399 | A1 | 5/2010 | Dowdeswell et al. | |
| 2013/0209222 | A1 | 8/2013 | Schofield | |
| 2019/0113036 | A1 | 4/2019 | Kolvenbach et al. | |

OTHER PUBLICATIONS

PCT Notification of Transmittal of the International Preliminary Report on Patentability dated Mar. 24, 2021 and PCT International Search Report and PCT Written Opinion dated Mar. 24, 2021 for corresponding PCT application Serial No. PCT/GB2021/050300, 10 pages.

* cited by examiner

MULTIPLE STAGE VACUUM PUMP

CROSS-REFERENCE TO RELATED APPLICATION

This application is a Section 371 National Stage Application of International Application No. PCT/GB2021/050300, filed Feb. 10, 2021, and published as WO 2021/161009A1 on Aug. 19, 2021, the content of which is hereby incorporated by reference in its entirety and which claims priority of British Application No. 2001932.9, filed Feb. 12, 2020.

FIELD

The field of the invention relates to multi-stage vacuum pumps.

BACKGROUND

In multi-stage vacuum pumps transfer channels are required to transfer fluid between the stages as it is pumped from an inlet to an outlet of the vacuum pump. These transfer channels require space within the stator block. Where additional access to the chambers is required such as where gas ballast may be added to one or more stages, then the provision of these additional channels and/or valves is required and can become challenging. This is particularly the case for smaller compact pumps.

Embodiments seek to provide a compact multistage pump with a gas ballast inlet channel for providing ballast gas to one of the stages of the pump.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a multistage vacuum pump comprising:

a stator defining multiple pumping chambers;

said stator comprising a plurality of transfer channels each providing a fluid passage from an outlet port of one of said pumping chambers to an inlet port of a subsequent pumping chamber;

at least one of said transfer channels comprises two side channel sections on opposing side of said stator; and at least one of said transfer channels comprises a single side channel section on one side of said stator, said vacuum pump further comprising a gas ballast inlet channel arranged on an other side of said stator to said one side of said stator.

The inventor of the present invention recognised that multistage vacuum pumps particularly compact multistage vacuum pumps have a limited space within the stator for the pumping chambers and the transfer channels for conducting fluid between the pumping chambers of the different stages. In this regard, transfer channels should be sized such that their cross-section is sufficiently large to allow gas to flow between the chambers without significant pressure loss.

As a vacuum pump pumps from a high vacuum to a lower vacuum the volume of gas pumped at the inlet end is significantly larger than the volume pumped at the outlet end and thus, the pumping chambers and transfer channels may also reduce in size from the inlet to the outlet.

In some pumps it may be advantageous to provide a gas ballast inlet channel for introducing a ballast gas into the vacuum pump during certain stages of the pumping cycle to inhibit the condensation of condensable gases being pumped such as water vapour. The ballast gas may be air or an inert or process gas and the flow helps to 'dilute' the vapour inside the pumping mechanism, inhibiting for example water vapour from condensing as it is compressed up to nearer atmospheric pressure. This allows the pump to recover much faster to its ultimate pressure than if gas ballast is not used. Additionally gas ballast allows a higher volume of vapour to be pumped than without it as it helps inhibit condensation inside the pump.

These gas ballast inlet channels are generally provided towards the exhaust end of the vacuum pump as it is at this end with the higher pressures that the gases will condense. The inventors of the present invention recognised that towards the exhaust end of the vacuum pump the volume of gas pumped is generally smaller and thus, there might be an opportunity of providing a ballast gas inlet channel within the stator of the vacuum pump. In particular, the inventors recognised that although, in order to provide transfer channels with sufficient size not to inhibit flow they have generally been formed in two side sections on either side of the pumping chambers in the side walls of the stator with linking channels between the inlets and outlets, it may be that for one of the transfer channels a single side section just on one side of the stator could be used and in which case there would be available space on the other side of the stator where the other side channel would conventionally be. In such a case, it is possible to place a gas ballast channel in this side in the spare space provided by not having the second side section of one of the transfer channels. Thus, by adapting the transfer channel configuration within the stator, a gas ballast channel for providing gas ballast to one of the pumping chambers within the vacuum pump can be provided within the stator without the need to increase the size of the stator or the vacuum pump.

In some embodiments, a cross section of at least some of said sections of said transfer channels providing a fluid passage between pumping chambers closer to said vacuum pump inlet have a larger cross section than a cross section of said sections of said transfer channels between pumping chambers closer to said pump outlet.

As noted previously, as the gas is pumped through the vacuum pump it will be compressed and thus, the volume taken up by the gas will be less. Thus, the cross section of the transfer channels that is required for relatively uninhibited fluid flow towards the outlet of the vacuum pump is smaller than it is towards the inlet. Thus, in some embodiments at least some of the transfer channels between the pumping chambers may decrease in size from the inlet to the outlet and take advantage of the fact that the size required to provide the same pressure loss at the inlet is significantly larger than it is towards the outlet. Reducing the size of the transfer channels is an effective way of efficiently using the space within the stator.

In some embodiments, said transfer channel comprising said single side channel section has a larger cross section than a cross section of an adjacent upstream transfer channel.

However, where a transfer channel has only a single side channel section in order to make place for the gas ballast channel on the other side of the stator then this side channel may be made to have a larger cross section than channel sections where there are two side channels as the amount of gas flowing through this side channel will be double the amount that would be the case if there were two side channels. In this case for this transfer channel the cross section does not decrease compared to the cross section of a side channel section of an immediately preceding upstream transfer channel.

In some embodiments, said stator comprises side walls on opposing sides of said multiple pump chambers and cover portions for covering opposing faces of said multiple pumping chambers, said inlet and outlet ports of said plurality of pumping chambers extending towards said inlet and outlet cover portions respectively, wherein said cover portions comprise sections of said transfer channels for linking respective inlets and outlets to said side channel sections.

The transfer channels provide a passage for fluid to flow from an outlet of one pumping chamber to the inlet of a subsequent pumping chamber, the transfer channels may comprise one or more side channel portions running perpendicularly to the cover portions through one or both side walls of the stator and linking channels to link either end of the side channel portions to respective inlets and outlets. The linking channels are provided in the surfaces covering the pumping chambers at respective inlet and outlet ends.

In some embodiments, said stator comprises a clam-shell stator comprising two clam shell components, said side channel sections and pumping chambers extending into both of said clam shell components, one of said clam shells comprising an inlet clam, comprising an inlet portion of said pumping chambers and one comprising an outlet clam comprising an outlet portion of said pumping chambers.

In some embodiments the stator is formed as a clam shell type stator of two blocks, making mounting of the rotor within the stator more straightforward.

In some embodiments, said channel linking said pumping chamber inlet to said single side channel in said inlet cover portion is angled, said single side channel section being offset with respect to said pumping chamber inlet that said single side channel section is connected to via said linking channel, said side channel being closer to said vacuum pump inlet than said pumping chamber inlet is.

As noted previously, there is limited space for providing the transfer channels within the stator and the transfer channel that has a single side channel may have a larger cross section and, in order to provide space for this it may be convenient to angle the channel and offset the side channel with respect to the pumping chamber.

In some embodiments, said transfer channel adjacent to said channel comprising said single side channel and closer to said vacuum pump inlet, comprises linking portions in said inlet cover portion that are angled, said side channel sections being offset with respect to said pumping chamber inlet that said side channel sections are connected to via said linking channel, said side channel sections being closer to said vacuum pump inlet than said pumping chamber inlet is.

In order to provide additional space for the gas ballast inlet it may be advantageous to also angle the next transfer channel linking section towards the inlet. This may provide additional space both for a wider cross section side and linking channel sections for the transfer channel with the single side section and for the gas ballast inlet channel.

Although the single side channel may connect between any two of the pumping chambers, in some embodiments said transfer channel comprising said single side channel section is a channel connecting an antepenultimate pumping chamber to a penultimate pumping chamber, said penultimate pumping chamber being adjacent to an exhaust pumping chamber.

As noted previously, gas ballast is advantageously input to a vacuum pump towards the exhaust end of the vacuum pump and thus, it may be advantageous if the gas ballast channel is located within the stator towards the exhaust side of the vacuum pump too. In particular, it may be advantageous to locate it in a space vacated by a side channel linking the anti-penultimate to the penultimate pumping chamber.

In some embodiments, a portion of said gas ballast inlet channel is located at said other side of said stator at least partially to one side of said antepenultimate pumping chamber.

Where the transfer channel comprising the single side channel section is one that connects between the antepenultimate and the penultimate chamber then the gas ballast inlet channel may be located at least partially to one side of the antepenultimate pumping chamber in the space vacated by there not being a side channel to the transfer channel at this point.

In some embodiments, said gas ballast inlet channel comprises a cavity that contains a non-return valve for inhibiting flow from said pump to a gas ballast inlet port.

In order that gas being pumped by the vacuum pump does not flow out through the gas ballast inlet channel when the pressure in the pumping chamber rises a non-return valve may advantageously be arranged in this channel. It is convenient if this is close to the pumping chamber to avoid the buffering effect of any volume between the non-return valve and the pumping chamber and thus, this is a further reason that it is advantageous if the gas ballast channel is located close to the pumping chamber that it provides gas to. The non-return valve is located in a cavity within the channel and thus, does require a not insignificant volume.

In some embodiments, said gas ballast inlet channel comprises a control valve for admitting gas ballast through said gas ballast inlet channel or for sealing said pumping chambers from said gas ballast.

In order to control the input of the gas ballast to the vacuum pump a control valve may be provided so that gas ballast may be input at a particular stage in the pump being processed when and as required.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

Embodiments provide a multi-stage vacuum pump comprising a stator at least partially enclosing multiple vacuum chambers. The stator comprises transfer channels for transferring fluid between the multiple pumping chambers from an outlet of one pumping chamber to an inlet of a subsequent pumping chamber. These transfer channels are located within the stator.

In some embodiments, the stator comprises side walls between which the multiple pumping chambers and rotors are located and covering portions extending perpendicularly to the side walls to cover the upper and lower faces of the stator component or components comprising the multiple chambers. These covering portions may be separate plates, or may be part of a stator block comprising the side walls.

In some embodiments, some of the transfer channels have two side channel sections that travel through the side walls of the stator, these are located at least partially to either side of a respective pumping chamber. The inlet of the multiple pumping chambers extends towards an inlet covering portion and the outlet towards the opposing outlet covering portion. The transfer channels are configured to conduct fluid from the outlet of one pumping chamber along a linking channel in the outlet covering portion towards the side channel portion where it will flow through the side channel portion to a channel in the inlet covering portion where it will be conducted to the inlet of the subsequent pumping chamber.

It is preferable that the cross-sectional area of the fluid transfer channels is large enough not to unduly impede the flow.

As the fluid flows from the inlet to the vacuum pump towards the outlet it becomes compressed and thus, the cross-sectional area required for the fluid decreases and the transfer channel's cross-section may also decrease.

Embodiments provide a gas ballast inlet channel providing gas ballast to one of the pumping chambers in the vacuum pump towards the exhaust and in order to provide space for such a gas ballast inlet channel one of the transfer channels between the pumping chambers is configured to have only a single side section on one side of the stator leaving the other side of the stator available for the gas ballast channel. This single side section of the transfer channel will have an increased cross-section area compared to at least one of the neighbouring upstream transfer channels in order to provide sufficient conductance for the gas flow within this one channel.

Figure 1:
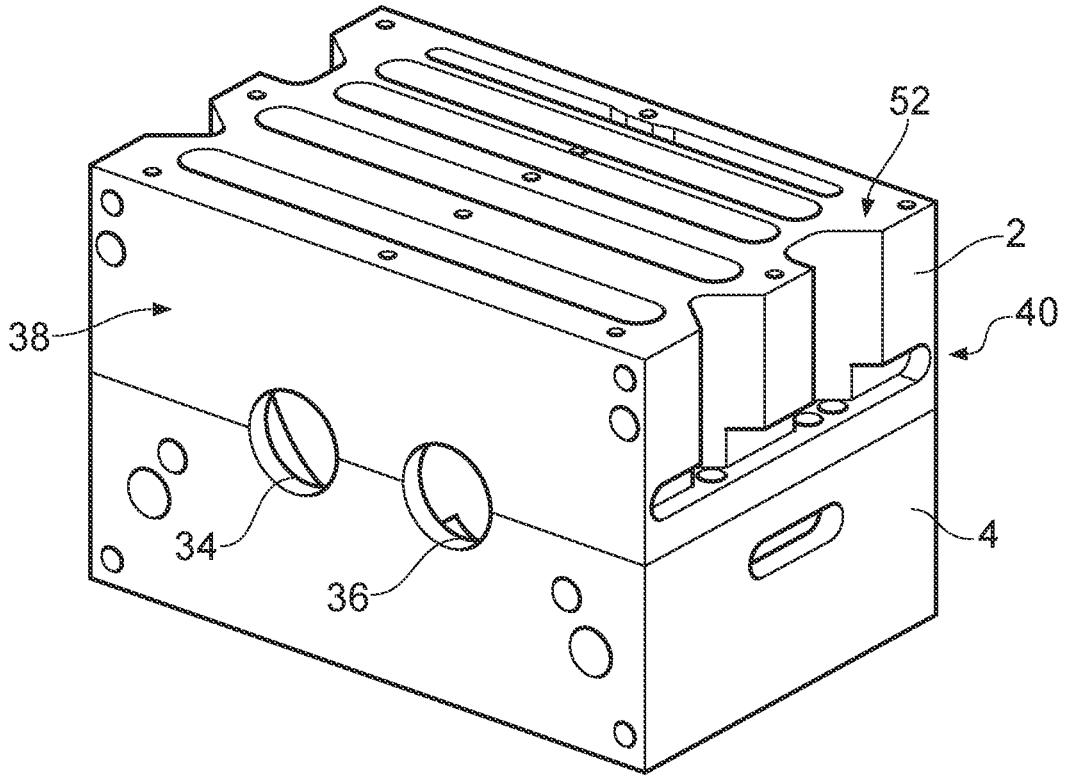
FIG. 1 (Prior Art)
FIG. 1 shows an isometric view of the main stator components of a vacuum pump according to the prior art.

FIG. 1 shows a vacuum pump stator according to the prior art comprising an inlet half shell stator component 2 and an outlet half shell stator component 4 which together form the main body of the stator block. In this example, the stator is for a five stage vacuum pump and comprises five pumping chambers which are separated by partition members in the form of transverse walls. These transverse walls are preferably integral with the stator components 2 and 4.

Apertures 34 and 36 are provided in the stator each for receiving a respective shaft of a rotor assembly of the vacuum pump. In this embodiment, the vacuum pump comprises a Roots vacuum pump and the rotors comprise Roots rotors. Head plates (not shown) are mounted on the end surfaces 38 and 40 of the stator components 2, 4 to seal the ends of the stator components 2, 4.

Each pumping chamber comprises an inlet linked to channels in the upper surface of component 2. Transfer channels between respective inlet and outlets of the pumping chambers, have side sections which run vertically through blocks 2 and 4 at either edge of the pumping chambers and these side sections extend into the channels shown in the upper surface providing a passage of gas from the side channel sections to the inlets of the pumping chambers.

The outlets of the pumping chambers open into channels (not shown) in a lower surface of outlet stator component 4 and there are linking channels in this surface providing a passage from the pump chamber outlet to respective side channels.

Figure 2:
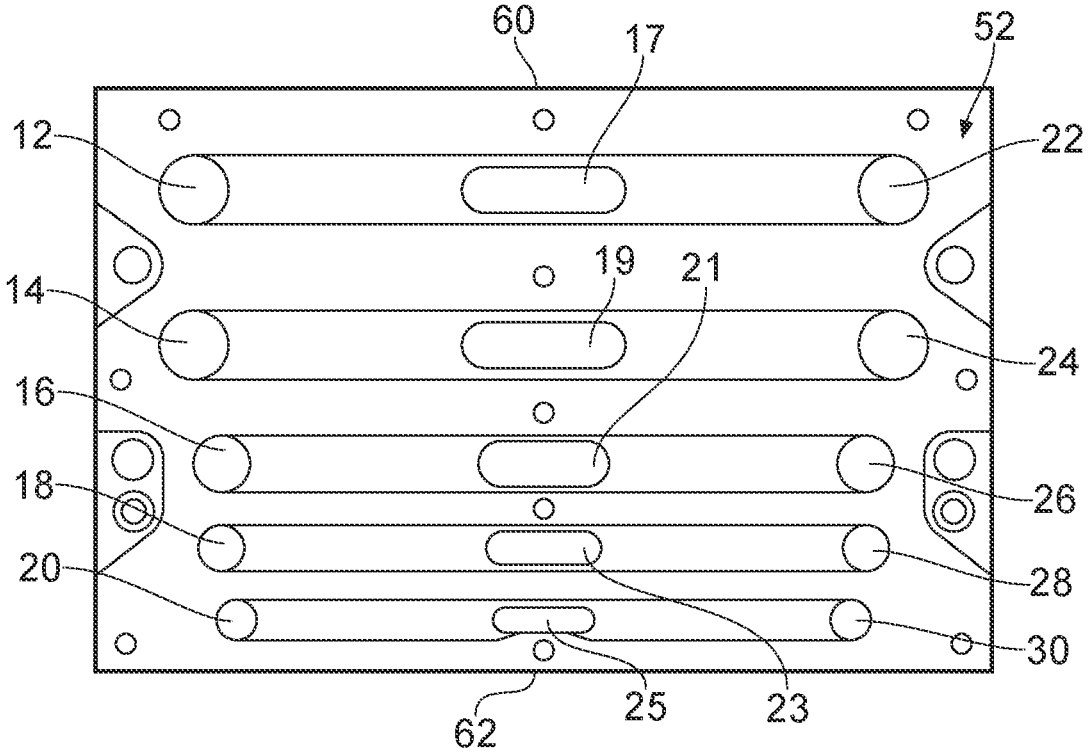
FIG. 2 (Prior Art)
FIG. 2 shows a top plan of the inlet stator component of FIG. 1.

FIG. 2 shows a view of upper surface 52 of inlet stator component 2 according to the prior art. This shows the inlets 17, 19, 21, 23 and 25 of the respective pumping chambers. There are also linking channels in the surface of this inlet stator component 2 which link the inlets to respective side channel sections of the transfer channels on either side of the stator. The openings of the side channel sections are shown as 12, 14, 16, 18, 20 on the left hand side and these are linked to the respective inlets of the pumping chambers by linking channels running along the surface 52 of the inlet stator portion. Similarly the side channel sections openings 22, 24, 26, 28 and 30 are shown on the right hand side and these are also linked via linking channels to the inlets. In this vacuum pump of the prior art there are side channel sections for the transfer channels on either side of the pumping chambers for each of the pumping chambers and the cross-section of the side channels sections decreases from the inlet side of the vacuum pump 60 to the outlet side 62. The side channels are located to one side of the pumping chamber such that the linking channels in the inlet stator portion run perpendicularly to the side walls.

Figure 3:
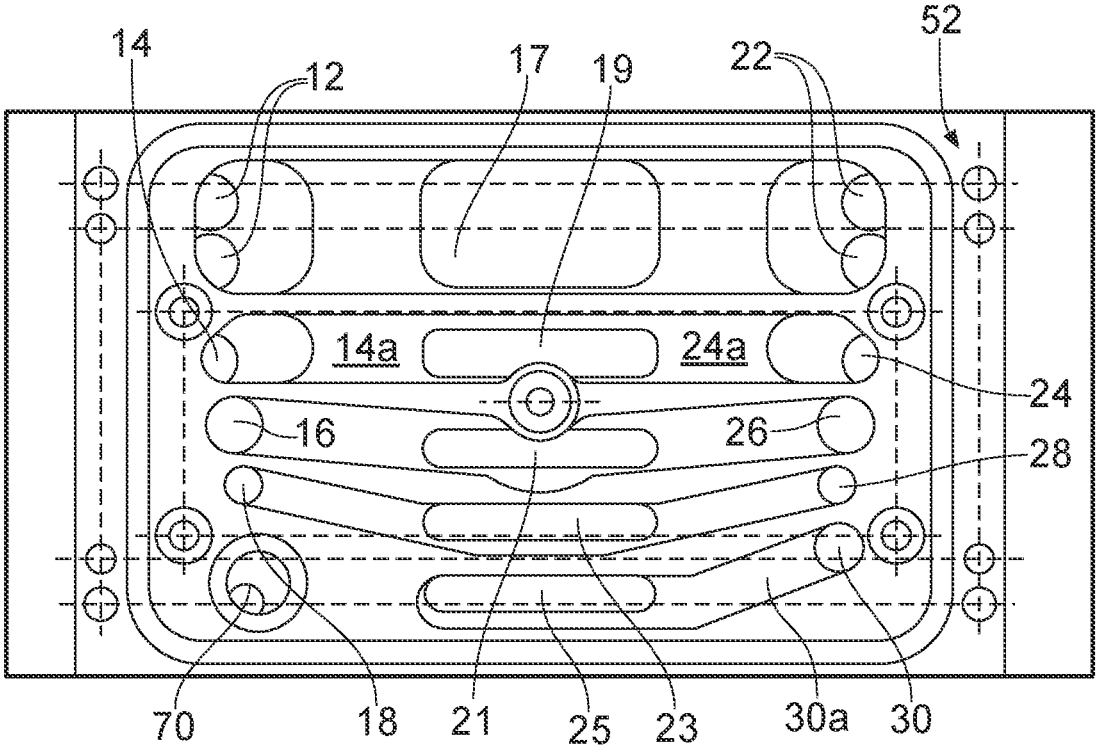
FIG. 3 shows a top plane of the inlet stator component according to an embodiment.

FIG. 3 shows an end view of the upper face 52 of an inlet stator component 2 according to an embodiment. In this component there are five pumping chamber inlets shown although there are seven pumping chambers with this multistage pump and inlet stage is within the inlet head plate (not shown) and the outlet stage is located underneath the groove surrounding the stator component for accommodating the seal and therefore is not visible in FIG. 3.

Figure 4:
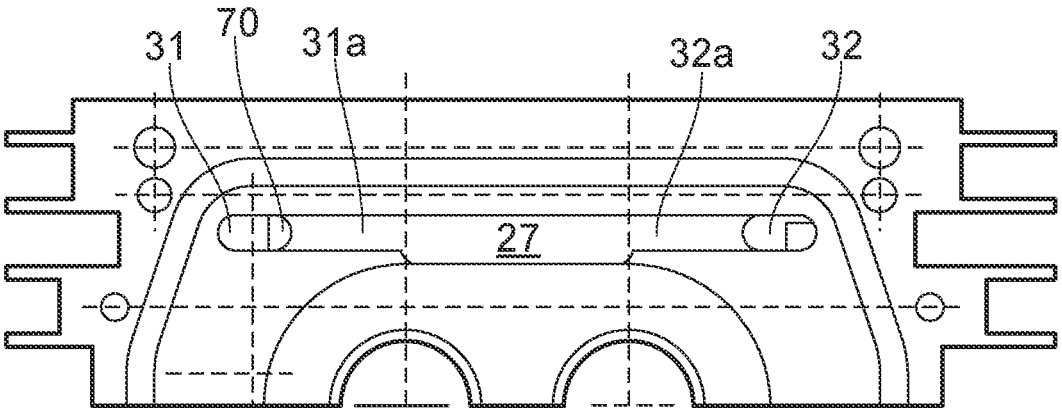
FIG. 4 shows the end face of a stator inlet component according to an embodiment.

FIG. 3 shows an inlet 17 to a second pumping chamber and subsequent inlets 19, 21, 23 and 25 with a further inlet 27 to the exhaust pumping stage being shown in FIG. 4. There are transfer channels for transferring fluid between the stages of the multistage vacuum pump and these each have side sections which run through the side of the stator at least partially adjacent to the pumping chambers. For the second pumping chamber with inlet 17 there are two side channel sections on either side to provide sufficient flow for the lower pressure gas. These two side channel sections are shown as 12 on the left hand side and 22 on the right hand side. The subsequent pumping chamber has a side channel section 14 on the left and 24 on the right. These side channels are configured to receive fluid from the outlet of the previous pumping chamber which is on the opposing face of the other stator component 4 and the fluid flows up through the channels to the inlet face and then along the linking channels 14*a* and 24*a* to the inlet 19.

The fluid is then pumped through the pumping chamber and output at the outlet in the outlet face of stator component 4 into subsequent side channels 16 and 26 whereupon the fluid travels up to the inlet face 52 of the inlet component 2 and from there through the linking channels into the inlet 21 of the subsequent pumping chamber.

In this embodiment, a gas ballast inlet channel 70 is provided for inputting ballast gas into the exhaust stage of the vacuum pump. In this embodiment, the gas ballast inlet channel 70 is located to one side of the penultimate pumping chamber whose inlet is 25. This penultimate pumping chamber receives fluid from a transfer channel which has only one side section 30 which transfer channel transfers fluid from the antepenultimate pumping chamber to the penultimate pumping chamber. As there is only one side channel section this transfer channel has a larger cross-sectional area than the transfer channel transferring fluid between the previous two pumping chambers. This provides space on the other side of the stator for the gas ballast inlet channel 70.

As we are towards the exhaust end of the vacuum pump the cross-sectional area required for the transfer channels is lower and thus, increasing the cross sectional area of the transfer channel side section is not unduly onerous on space. However, the space is limited and thus, in this embodiment the side channel 30 is offset with respect to the pumping chamber and the pumping chamber inlet 25 and thus the linking channel 30*a* is angled. This allows the channel to be larger and still provides space for the subsequent side channel to the next exhaust stage which side channel does not open onto the surface 52 but rather travels across under the surface and is shown in FIG. 4.

FIG. 4 shows an end view of the inlet stator component 2 with pumping chamber inlet 27 to the exhaust pumping chamber. The gas ballast inlet passage 70 opens into the connecting linking channel 31*a* which links it and the side section of the left hand transfer channel 31 from the penultimate to the exhaust stage to the inlet 27 of the exhaust pumping stage. Thus, both gas ballast and fluid from the penultimate pumping chamber flow through linking channel 31*a* to inlet 27. There is an additional linking channel 32*a* that links the side section of the right hand transfer channel 32 to the inlet of the exhaust pumping chamber.

Figure 5:
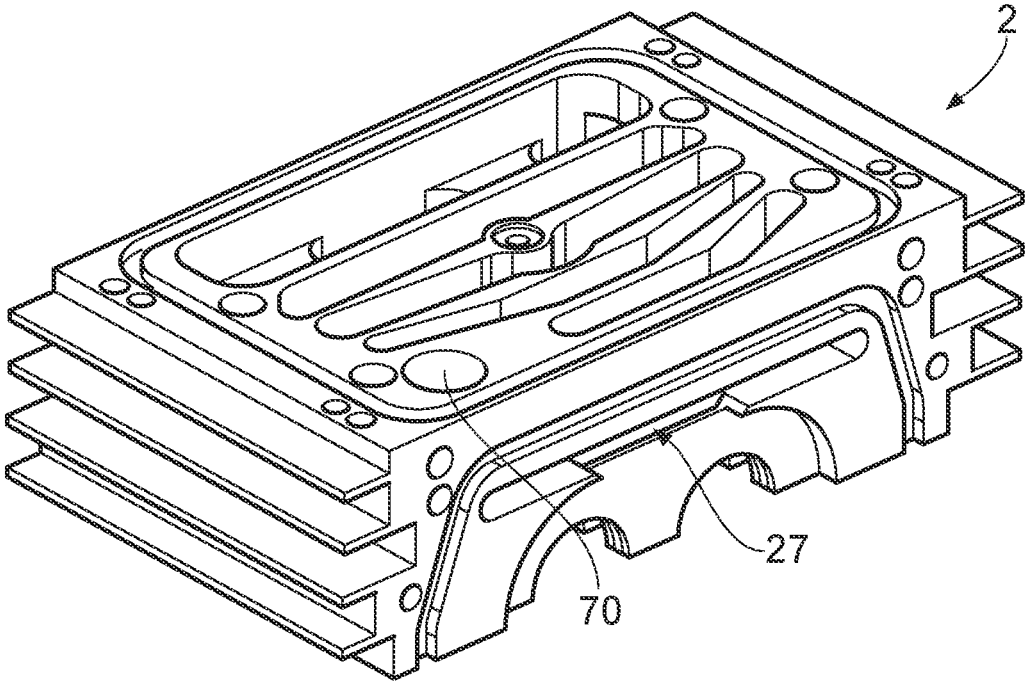
FIG. 5 shows an isometric view of a stator inlet component according to an embodiment.

FIG. 5 shows inlet stator component 2 in an isometric view. Gas ballast inlet channel 70 is shown with an opening on the upper surface of this component and the linking channels linking the side sections of the transfer channels to the inlets are also shown. The side channels extend down from these linking channels and are not visible. The end face is visible and shows how the inlet 27 to the exhaust stage is linked by its own linking channels.

The flow of gas through the vertical side channels flows in an upwards direction as shown in the figures through the transfer channels from the outlet of respective pumping chambers in the lower surface of the stator outlet block 4 to the upper surface of the inlet stator block. The gas ballast channel receives ballast gas from an opening in the upper surface 52 of the inlet clam and it flows down to the inlet of the exhaust stage.

The gas ballast channel has a non-return valve (not shown) located in the channel close to the exhaust pumping chamber to inhibit flow of gas from the pumping chamber to the ballast gas inlet port and a control valve (also not shown) for controlling the input of ballast gas.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A multi-stage vacuum pump comprising:

a stator defining multiple pumping chambers;

said stator comprising a plurality of transfer channels each providing a fluid passage from an outlet port of one of said pumping chambers to an inlet port of a subsequent pumping chamber;

at least one of said transfer channels comprises two side channel sections on opposing side of said stator; and at least one of said transfer channels comprises a single side channel section on one side of said stator, said vacuum pump further comprising a gas ballast inlet channel arranged on an other side of said stator to said one side of said stator.

2. The multi-stage vacuum pump according to claim 1, wherein a cross section of at least some of said sections of said transfer channels providing a fluid passage between pumping chambers closer to said vacuum pump inlet have a larger cross section than a cross section of said sections of said transfer channels between pumping chambers closer to said pump outlet.

3. The multi-stage vacuum pump according to claim 1, wherein said transfer channel comprising said single side channel section has a larger cross section than a cross section of an adjacent upstream transfer channel.

4. The multi-stage vacuum pump according to claim 1, wherein said stator comprises side walls on opposing sides of said multiple pump chambers and cover portions for covering opposing faces of said multiple pumping chambers, said inlet and outlet ports of said plurality of pumping chambers extending towards said inlet and outlet cover portions respectively, wherein said cover portions comprise sections of said transfer channels for linking respective inlets and outlets to said side channel sections.

5. The multi-stage vacuum pump according to claim 4, wherein said channel linking said pumping chamber inlet to said single side channel in said inlet cover portion is angled, said single side channel section being offset with respect to said pumping chamber inlet that said single side channel section is connected to via said linking channel, said side channel being closer to said vacuum pump inlet than said pumping chamber inlet is.

6. The multi-stage vacuum pump according to claim 4, wherein said transfer channel adjacent to said channel comprising said single side channel and closer to said vacuum pump inlet, comprises linking portions in said inlet cover portion that are angled, said side channel sections being offset with respect to said pumping chamber inlet that said side channel sections are connected to via said linking channel, said side channel sections being closer to said vacuum pump inlet than said pumping chamber inlet is.

7. The multi-stage vacuum pump according to claim 1, wherein said stator comprises a clam-shell stator comprising two clam shell components, said side channel sections and pumping chambers extending into both of said clam shell components, one of said clam shells comprising an inlet clam, comprising an inlet portion of said pumping chambers and one comprising an outlet clam comprising an outlet portion of said pumping chambers.

8. The multi-stage vacuum pump according to claim 1, wherein said transfer channel comprising said single side channel section is a channel connecting an antepenultimate pumping chamber to a penultimate pumping chamber, said penultimate pumping chamber being adjacent to an exhaust pumping chamber.

9. The multi-stage vacuum pump according to claim 8, wherein a portion of said gas ballast inlet channel is located at said other side of said stator at least partially to one side of said antepenultimate pumping chamber.

10. The multi-stage vacuum pump according to claim 1, wherein said gas ballast inlet channel comprises a cavity that contains a non-return valve for inhibiting flow from said pump to a gas ballast inlet port.

11. The multi-stage vacuum pump according to claim 1, wherein said gas ballast inlet channel comprises a control valve for admitting gas ballast through said gas ballast inlet channel or for sealing said pumping chambers from said gas ballast.

* * * * *